US007384281B2

(12) United States Patent
Matsuoka et al.

(10) Patent No.: US 7,384,281 B2
(45) Date of Patent: Jun. 10, 2008

(54) GROUND TERMINAL FOR SHIELDED CABLES AND METHOD OF ASSEMBLING IT

(75) Inventors: Hiroyuki Matsuoka, Yokkaichi (JP); Makoto Sunohara, Yokkaichi (JP)

(73) Assignee: Sumitomo Wiring System, Ltd. (JP)

( * ) Notice: Subject to any disclaimer, the term of this patent is extended or adjusted under 35 U.S.C. 154(b) by 0 days.

(21) Appl. No.: 11/809,852

(22) Filed: Jun. 1, 2007

(65) Prior Publication Data

US 2007/0270024 A1 Nov. 22, 2007

(30) Foreign Application Priority Data

Jun. 2, 2006 (JP) ..... 2006-155229

(51) Int. Cl.
*H01R 4/66* (2006.01)

(52) U.S. Cl. ..... 439/92

(58) Field of Classification Search ..... 439/98, 439/92, 883, 907, 287, 578–585, 288, 284, 439/290, 801, 860, 497, 607–610; 174/84 C, 174/72 R, 76, 88 C See application file for complete search history.

(56) References Cited

U.S. PATENT DOCUMENTS 3,151,211 A * 9/1964 Reid et al. ..... 174/72 R
5,558,531 A 9/1996 Ikeda et al.
5,681,191 A 10/1997 Robicheau et al.
5,759,055 A * 6/1998 Colantuano et al. ..... 439/287
6,476,325 B2 * 11/2002 Kondo ..... 174/84 C
6,991,493 B2 1/2006 Matsui et al.
2006/0189184 A1 * 8/2006 Onuma ..... 439/98

FOREIGN PATENT DOCUMENTS

GB 1 200 752 8/1970

* cited by examiner

*Primary Examiner*—Edwin A. León
(74) *Attorney, Agent, or Firm*—Gerald E. Hespos; Anthony J. Casella

(57) ABSTRACT

A pair of shielded cables (20) having upper and lower ground terminals (30, 50) mounted thereon are brought in directions toward each other to slide upper and lower joint portions (31, 51) while placing them one over the other. Upon this assembling operation, the shielded cables (20) are brought into contact with arcuate standing portions (43, 63) formed at cable mounting portions (42, 62) or embraced by barrel pieces (44, 64) standing up from the arcuate standing portions (43, 63), thereby having displacements thereof relative to the upper and lower ground terminals (30, 50) prevented. Thus, operation forces can be reliably transmitted to the upper and lower joint portions (31, 51) via the shielded cables (20), and the assembling operation can be performed smoothly.

12 Claims, 11 Drawing Sheets

GROUND TERMINAL FOR SHIELDED CABLES AND METHOD OF ASSEMBLING IT

BACKGROUND OF THE INVENTION

1. Field of the Invention

The invention relates to a ground terminal for shielded cables and to a method of assembling it.

2. Description of the Related Art.

Shielded cables are used widely, for example, in electric automotive vehicles so that electromagnetic waves do not seriously affect electric equipment in the vehicles. U.S. Pat. No. 6,991,493 discloses a grounding connection for shielded cables that uses space efficiently so that two shielded cables can be arranged side by side. This grounding connection uses terminals that have a cable connection and a terminal mount. The cable connection is a ring configured to fit to a braided wire of one of two side by side shielded cables. The terminal mount projects from the cable connection towards the terminal mount of the other shielded cable. The two terminal mounts are placed one over the other before the grounding connection, and a shaft for grounding is inserted through aligned insertion holes for the grounding connection. Both shielded cables are grounded at a common position, and hence less space is used and the shield performance of the cables can be equalized as compared to a case where the shielded cables are grounded individually.

To connect the terminal mounting portions, an operator presses the side surfaces of both cable connections to bring the cable connections towards each other. The cable connections and the terminal mounts are at the same positions with respect to the length direction. As a result, operation forces applied to the cable connections can be translated directly into forces for connecting the terminal mounts. However, the cable connections are crimped into fixed connection with the outer circumferential surfaces of the braided wires. Thus, crimping forces are absorbed by the resiliency of inner coatings below the braided wires, and the cable connections might be connected unstably. As a countermeasure, ends of the outer coatings may be stripped to expose the braided wires. The cable connections then could be crimped into connection with the outer circumferential surfaces of the end portions of the outer coatings. The braided wires exposed from the inner coatings then could be placed on the cable connections and could be folded back towards the outer coatings. Separate crimp rings then could be mounted on and crimped into connection with the braided wires. In this way, the cable connections receive crimping forces applied to the crimp rings by being placed underneath the braided wires and reliable crimping could be performed.

The above-described cable connections and the terminal mounts must be displaced lengthwise because the crimp rings are fit. Thus, in the case where an attempt is made to assemble the terminal mounts with each other, operation forces cannot effectively act on the terminal mounts due to this displacement even if the operation forces are exerted on the cable connecting portions. Further, an operating position is small and it is difficult to perform the operation. Besides, there are no suitable operating positions in the terminal mounts. Accordingly, assembly of the terminal mounts by holding the respective shielded cables can be assumed for ease of the operation. In this case as well, it is not easy to assemble the terminal mounts since the shielded cables and the terminals easily are displaced from each other.

The invention was developed in view of the above, and an object thereof is to allow easy assembly of terminals mounted on shielded cables.

SUMMARY OF THE INVENTION

The invention relates to a ground terminal for shielded cables. The ground terminal includes at least one pair of cable mounting portions to be mounted on outer coatings of at least one pair of shielded cables having device connection terminals connected near the leading ends thereof. At least two shields are arranged near one end of the corresponding cable mounting portion and are connectable with a shielding layer of the corresponding shielded cable. Joints bulge from the corresponding cable mounting portions at an angle to the length direction of the shielded cables and substantially face each other. The joints can be assembled with each other while being moved along their extending directions. At least one displacement preventing means is provided on the cable mounting portion for contacting the shielded cables and preventing displacements of the shielded cables during assembly of the respective joints.

The ground terminal can be mounted first to the respective shielded cable. More particularly, the shields of the ground terminal are connected with the shielding layers of the cable. The joints bulge out in directions as to face each other, and hence face each other when the shielded cables are arranged side by side. In this state, the shielded cables are brought towards each other and the joints are slid while being placed one over the other. The displacement preventing means contact the shielded cables during this assembly and prevent displacements of the shielded cables. Thus, operation forces can be transmitted reliably to the joints via the cables so that the assembling operation can be performed smoothly.

The joints preferably have insertion holes that align when the joints are assembled by being placed one over the other and slid along their extending directions.

The joints preferably are displaced back from the shields in the length direction of the shielded cables.

The ground terminal first is mounted on the respective shielded cable so that the shields are connected with the shielding layers. The joints bulge out and face each other when the two shielded cables are arranged side by side. In this state, the shielded cables are brought towards each other and the joints are slid while being placed one over the other. Then, the upper and lower joints are assembled with the insertion holes aligned. The shielded cables contact the displacement preventing means during this assembling operation to prevent displacement of the shielded cables. Thus, operation forces can be transmitted reliably to the joints via the cables so that the assembling operation can be performed smoothly.

The invention enables the length of unshielded parts of the shielded cables to be shortened. Specifically, an unshielded area is a length area from a connection position with the shielding layer to a connection position of the device connection terminal. Thus, assuming a specified distance between the connection position of the device and the grounding position via the insertion hole in a place where the shielded cable is laid, the unshielded area can be shortened as compared to a conventional case where the grounding position and the connection position with the shielding layer are at the same positions with respect to forward and backward directions since the connection position with the shielding layer is before the grounding position.

At least one barrel piece preferably stands at a lateral edge of at least one cable mount and can be crimped, bent or folded into connection with the outer coating of the corresponding shielded cable. The barrel piece preferably forms part of the displacement preventing means. Accordingly, displacements of the shielded cables can be prevented during the assembling operation of the joints by crimping, bending or folding the barrel pieces into connection with the outer coatings of the shielded cables.

Each barrel piece preferably is arranged at or near the lateral edge of the corresponding cable mount substantially opposite to the joint and at least partly within the length range of the joint. Accordingly, the ground terminal is not enlarged in the length direction.

At least one arcuate standing portion is formed on the inner surface of each cable mount and has an arcuate cross section at least partly conformable to the outer circumferential shape of the outer coating of the shielded cable. The arcuate standing portion preferably defines at least part of the displacement preventing means by forming the joints in a manner to be continuous with the upper edges of the arcuate standing portions. Accordingly, the construction of the ground terminal is simplified since the cable mounts are utilized as the displacement preventing means.

Each shielding portion preferably includes at least two crimping pieces to be crimped into connection with the outer coating.

Each shielding layer preferably is exposed by partly stripping off the outer coating near an end of the shielded cable. The exposed shielding layer then is folded back towards the outer circumferential surface of the outer coating and is placed on both crimping pieces. At least one crimp ring then is crimped into connection with the outer circumferential surface of each folded back shielding layer. Accordingly, the crimp rings are crimped, bent or folded with the crimping pieces at least partly beneath the shielding layers. Therefore, unlike the prior art, crimping forces act reliably on the shielding layers.

The insertion holes preferably are long in the length direction of the shielded cables. Accordingly, a variation in the position of a shaft for grounding to be inserted into the insertion holes can be accommodated.

The invention also relates to a method of assembling a ground terminal for shielded cables. The method includes mounting cable mounts on outer coatings of at least two shielded cables having device connection terminals connected at their leading ends. The method then includes connecting at least two shields arranged near one end of the corresponding cable mount with a shielding layer of the corresponding shielded cable. The method proceeds by assembling at least two joints by sliding the joints along their extending directions and at an angle to the length direction of the shielded cables. The method further includes bringing displacement preventing means on the cable mounts into contact with the shielded cables for preventing displacements of the shielded cables during assembly the respective joints.

These and other objects, features and advantages of the invention will become more apparent upon reading the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
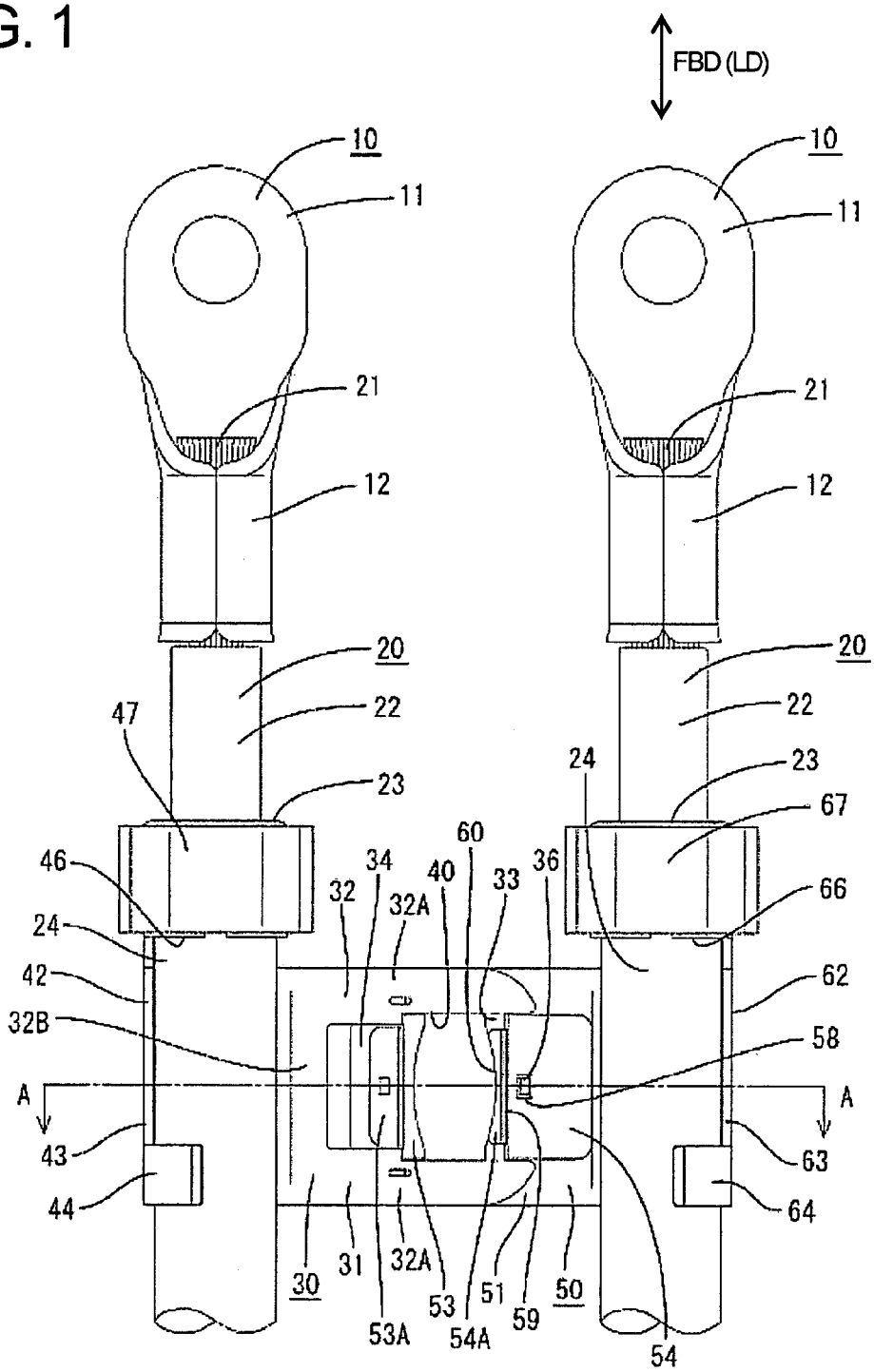
FIG. 1 is a plan view showing a state where upper and lower ground terminals according to one embodiment are mounted on shielded cables.

A ground terminal for shielded cables according to this invention is used with two shielded cables 20. In the following description, the leading end of each shielded cable 20 (upper end in FIG. 1) is referred to as the front, the end opposite the leading end is referred to as the rear, and right and left sides in FIG. 1 are referred to as the right and left sides of the respective elements.

Each shielded cable 20 has a core 21 formed by bundling a plurality of strands, an inner coating 22 covering the core 21, a braided wire 23 as a shielding layer surrounding the inner coating 22 and an outer coating 24 covering the braided wire 23. It should be understood that the core may be a single wire, such as a copper wire. The shielding layer preferably is formed by braiding thin electrically conductive metal wires, but may be a conductor layer formed e.g. from a thin metal film or plate surrounding the inner coating 22.

End processing is applied to an end of the shielded cable 20 to expose the braided wire 23 and the core 21. A device connection terminal 10 then is fixed to the core 21 exposed at the end of each shielded cable 20. Each device connection terminal 10 is formed by bending, folding and/or embossing a conductive metal plate punched or cut into a specified shape and has a ring-shaped connection plate 11 and a crimping portion 12 having the connection plate 11. Crimping pieces stand up from the opposite left and right edges of a rear part of the crimping portion 12 and are crimped, bent or folded into connection with the core 21 of the shielded cable 20.

An upper ground terminal 30 and a lower ground terminal 50 are mounted behind and substantially adjacent the device connection terminals 10, and near the front ends of the outer coatings 24 of the shielded cables 20. The upper and lower ground terminals 30, 50 are formed by bending, folding and/or embossing electrically conductive metal plates punched or cut into specified shapes. The upper and lower ground terminals 30, 50 include an upper joint 31 and a lower joint 51 that extend substantially normal to the length direction of the shielded cables 20. The upper and lower joints 31, 51 substantially face each other and can be placed at least partly one over the other (see FIG. 2).

Figure 3:
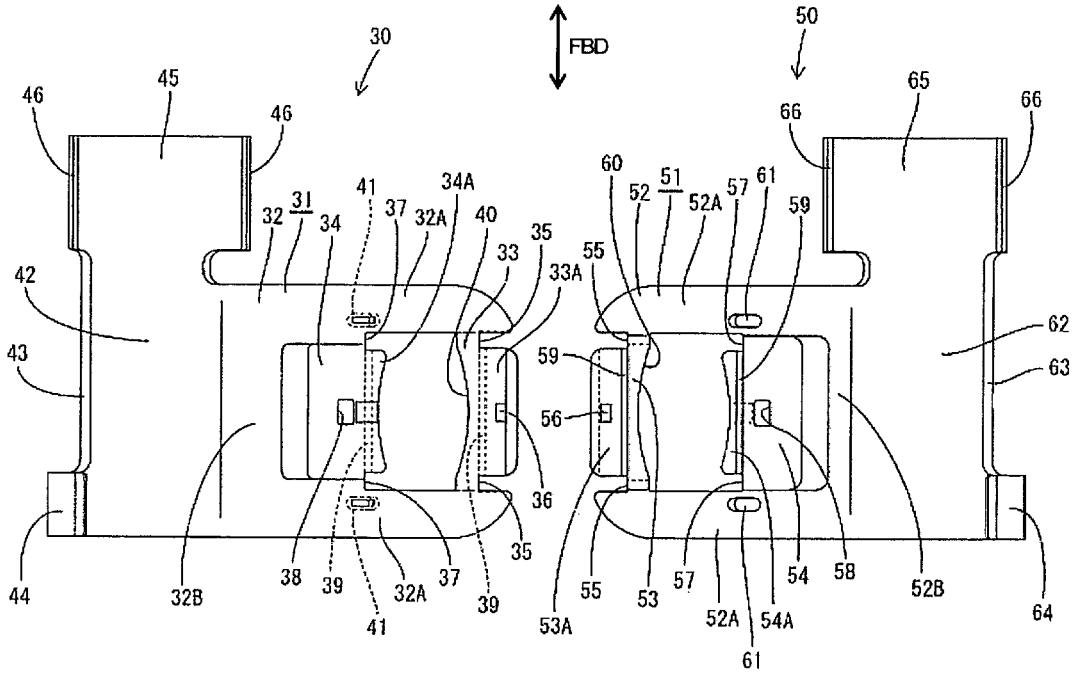
FIG. 3 is a plan view of the upper and lower ground terminals.

As shown in FIG. 3, the upper and lower joints 31, 51 are substantially rectangular plates with rounded bulging ends. The upper joint 31 includes a substantially flat plate 32 with front and rear extensions 32A extending substantially normal to the forward and backward directions FBD. A juncture 32B lies in substantially the same plane as the extensions 32A and connects the left ends of the extensions 32A in forward and backward directions FBD to provide increased bending rigidity to the flat plate 32 in forward and backward directions FBD (length direction LD of the shielded cables 20). Thus, the flat plate 32 is unlikely to bend when the shielded cables 20 are lifted up with the upper and lower joints 31, 51 assembled together. Accordingly, the properly assembled upper and lower joints 31, 51 are not likely to be disassembled inadvertently.

The upper joint 31 includes a first engaging portion 33 that bridges the right extending ends of the extensions 32A of the flat plate 32, and a second engaging portion 34 that bulges out to right in the extending direction of the extensions 32A from the juncture 32B.

Figure 2:
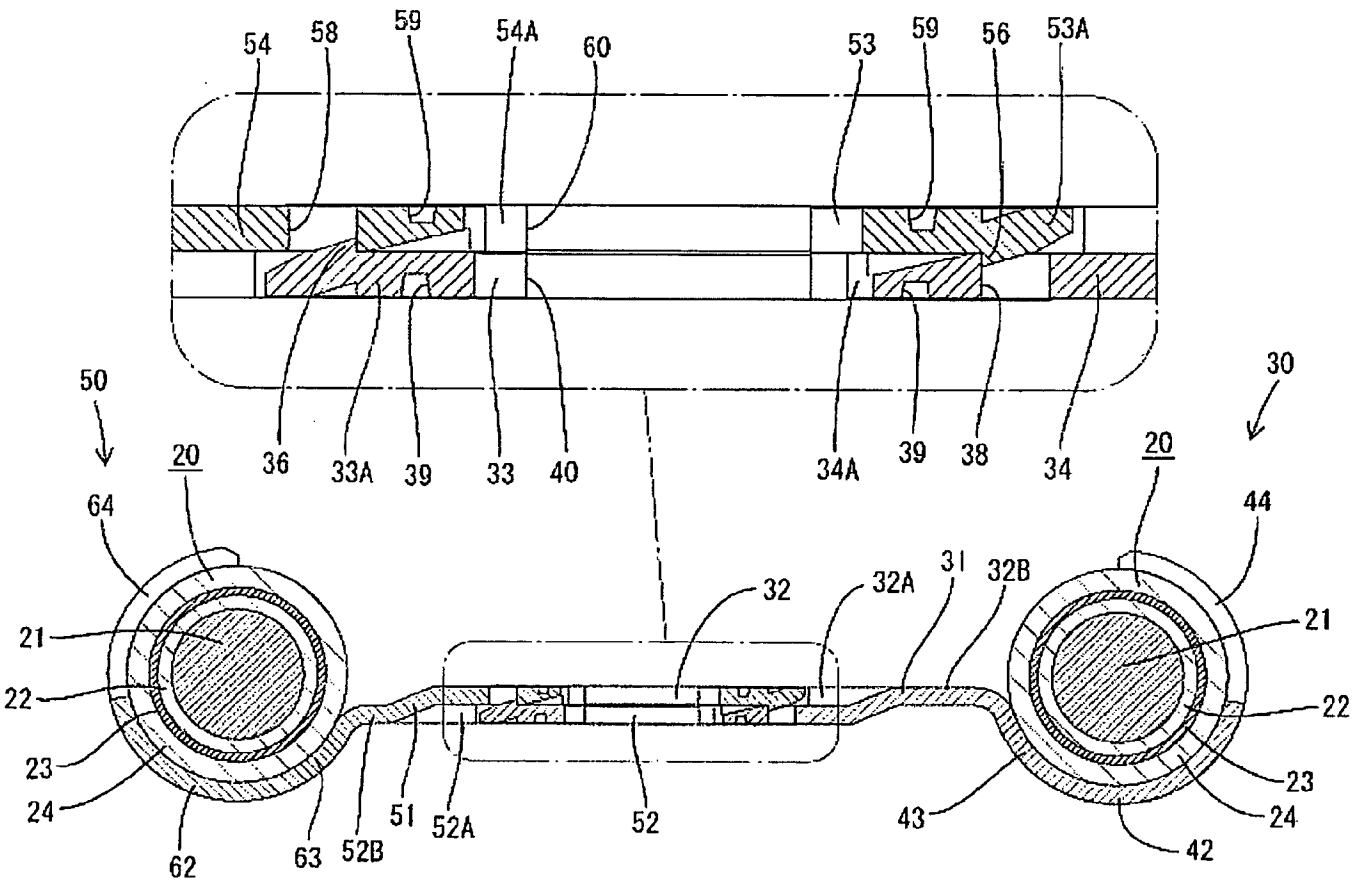
FIG. 2 is a section along A-A of FIG. 1.
Figure 4:
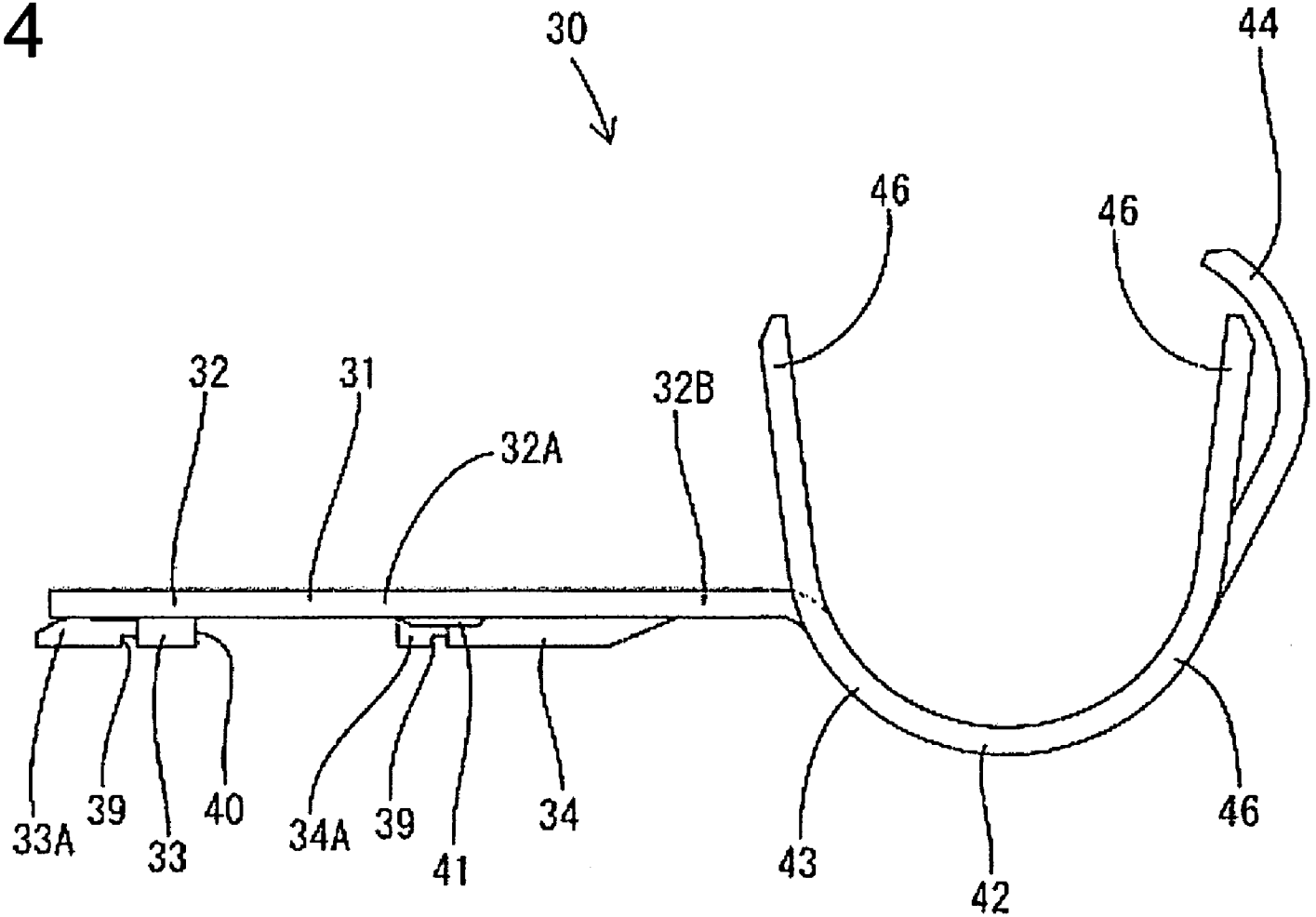
FIG. 4 is a front view of the upper ground terminal.
Figure 5:
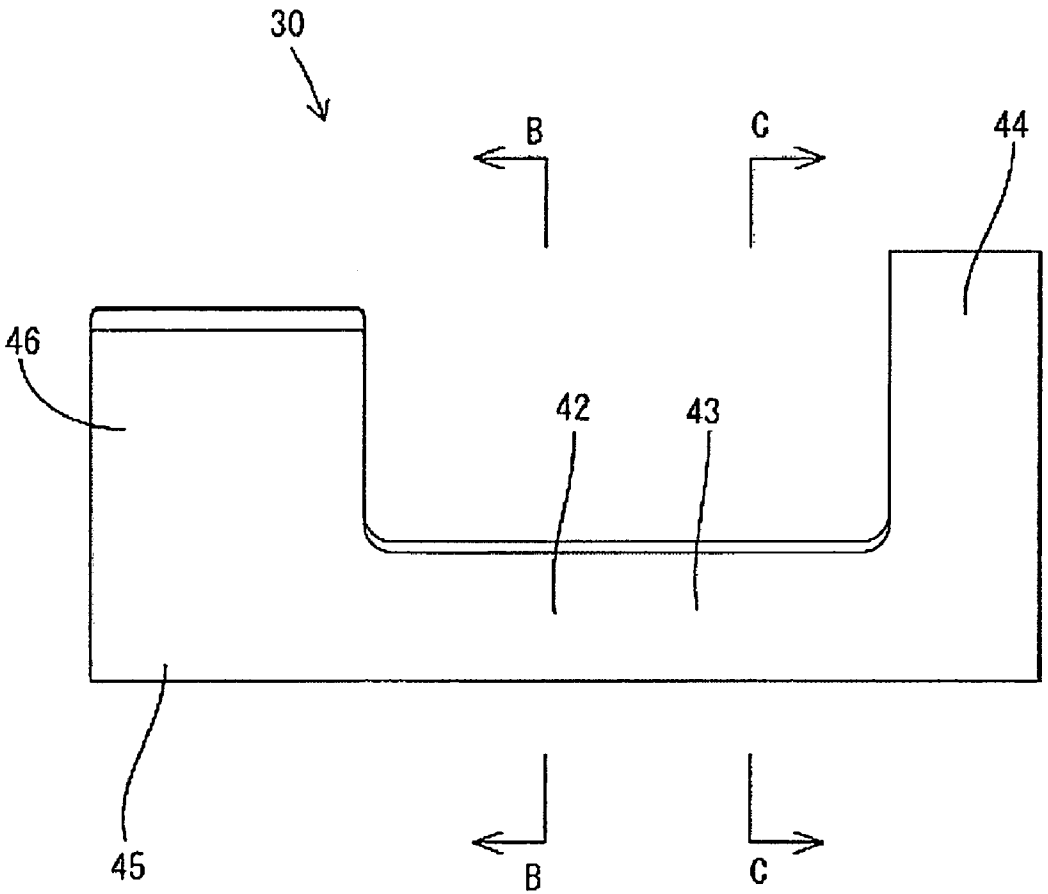
FIG. 5 is a left side view of the upper ground terminal.
Figure 6:
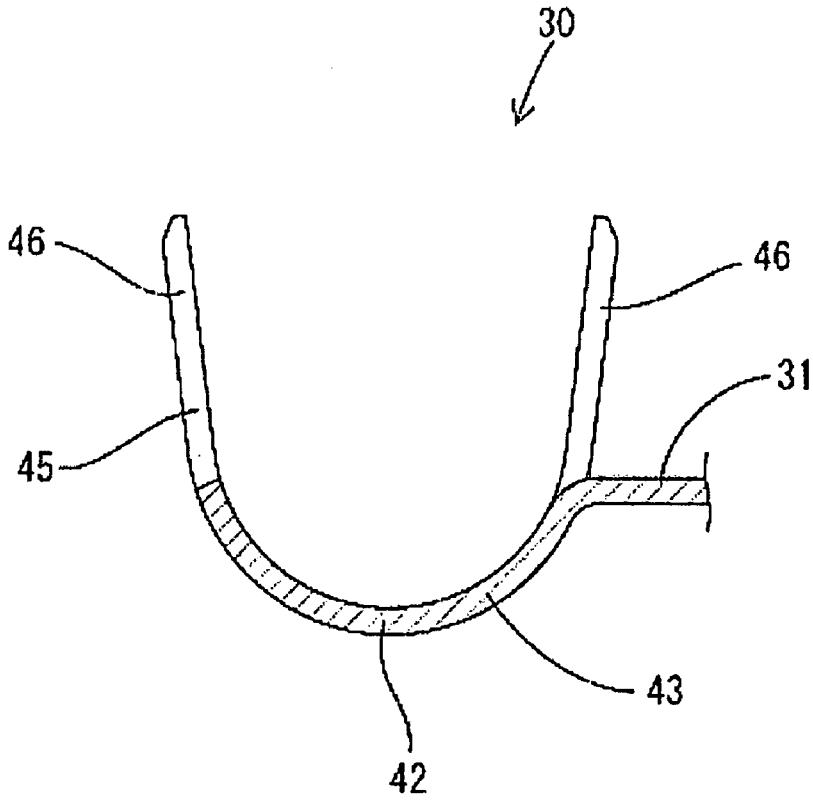
FIG. 6 is a side view partly in section along B-B of FIG. 5.
Figure 7:
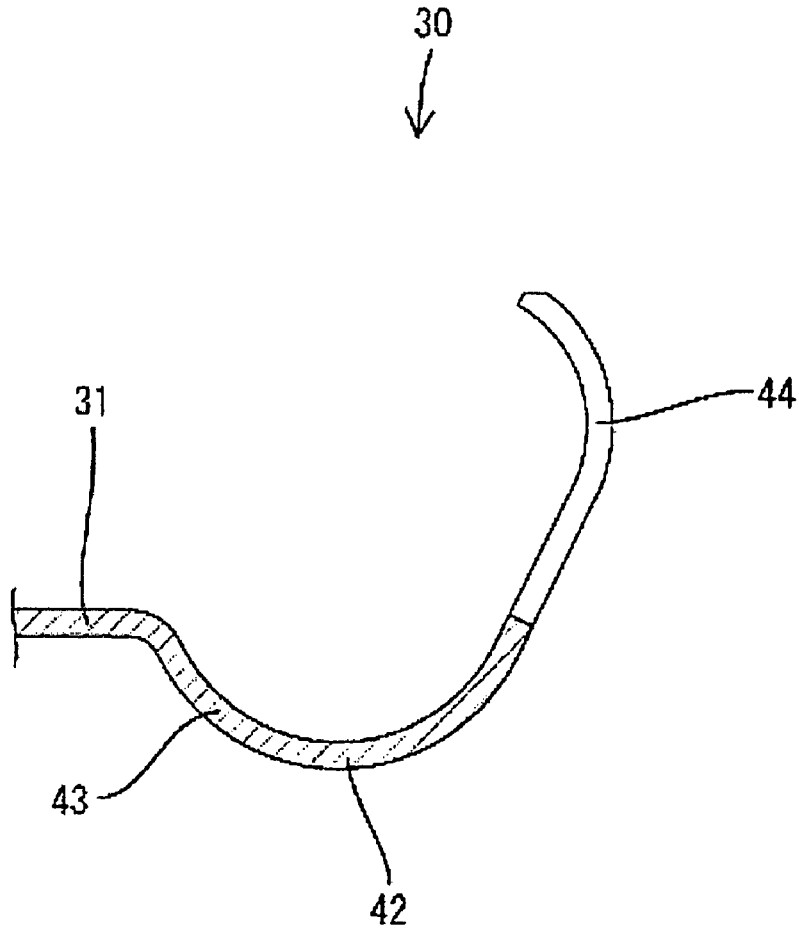
FIG. 7 is a side view partly in section along C-C of FIG. 5.

The first engaging portion 33 is stepped down at the front and rear connections with the extensions 32A so that the first engaging portion 33 is lower than the flat plate 32 by about the thickness of the plate, as shown in FIG. 4. A first inserting portion 33A extends to the left in FIG. 4 substantially along the plate surface of the first engaging portion 33. As shown in FIG. 3, open ended slits 35 are formed between the front and rear end edges of the first inserting portion 33A and the front and rear extensions 32A. A downwardly sloped lock 36 is embossed to project up at a middle part of the first inserting portion 33A, as shown in FIG. 2.

The second engaging portion 34 also is stepped down at the front and rear connections with the extensions 32A so that the second engaging portion 33 is lower than the flat plate 32 about by the thickness of the plate, as shown in FIG. 4. As a result, the first and second engaging portions 33, 34 are substantially coplanar. A second inserting portion 34A extends laterally to the left in FIG. 4 substantially along the plate surface of the second engaging portion 34. As shown in FIG. 3, open ended slits 37 are formed between the front and rear end edges of the second inserting portion 34A and the front and rear extensions 32A. Further, a locking hole 38 penetrates the second engaging portion 34 in thickness direction and has a rectangular shape slightly longer in forward and backward directions FBD.

Grooves 39 are recessed in the lower surfaces of the first and second inserting portions 33A, 34A and extend in forward and backward directions FBD over substantially the entire length of the first and second inserting portions 33A, 34A. The first and second inserting portions 33A, 34A are resiliently displaceable up and down at the grooves 39 (see FIGS. 3 and 4).

An insertion hole 40 is defined by the extensions 32A, the first engaging portion 33 and the second engaging portion 34 and can receive an unillustrated bolt. The insertion hole 40 has a substantially rectangular shape that is longer in forward and backward directions FBD, and hence along the length direction LD of the shielded cables 20.

The lower joint 51 of the lower ground terminal 50 has a slightly shorter transverse width than the upper joint 31. As shown in FIG. 3, the lower joint 51 includes a substantially flat plate 52 comprised of front and rear extensions 52A and a juncture 52B. The front and rear extensions 52A extend substantially normal to the forward and backward directions FBD. The juncture 52B lies in substantially the same plane as the extensions 52A and connects the lateral ends of the both extensions 52A in forward and backward directions FBD. It should be noted that the juncture 52B of the lower joint 51 has a smaller transverse width than the juncture 32B of the upper joint 31.

A first engaging portion 53 bridges the extending ends of the extensions 52A of the flat plate 52 of the lower joint 51 and a second engaging portion 54 bulges out laterally in the extending direction of the extensions 52A from the juncture 52B.

Figure 8:
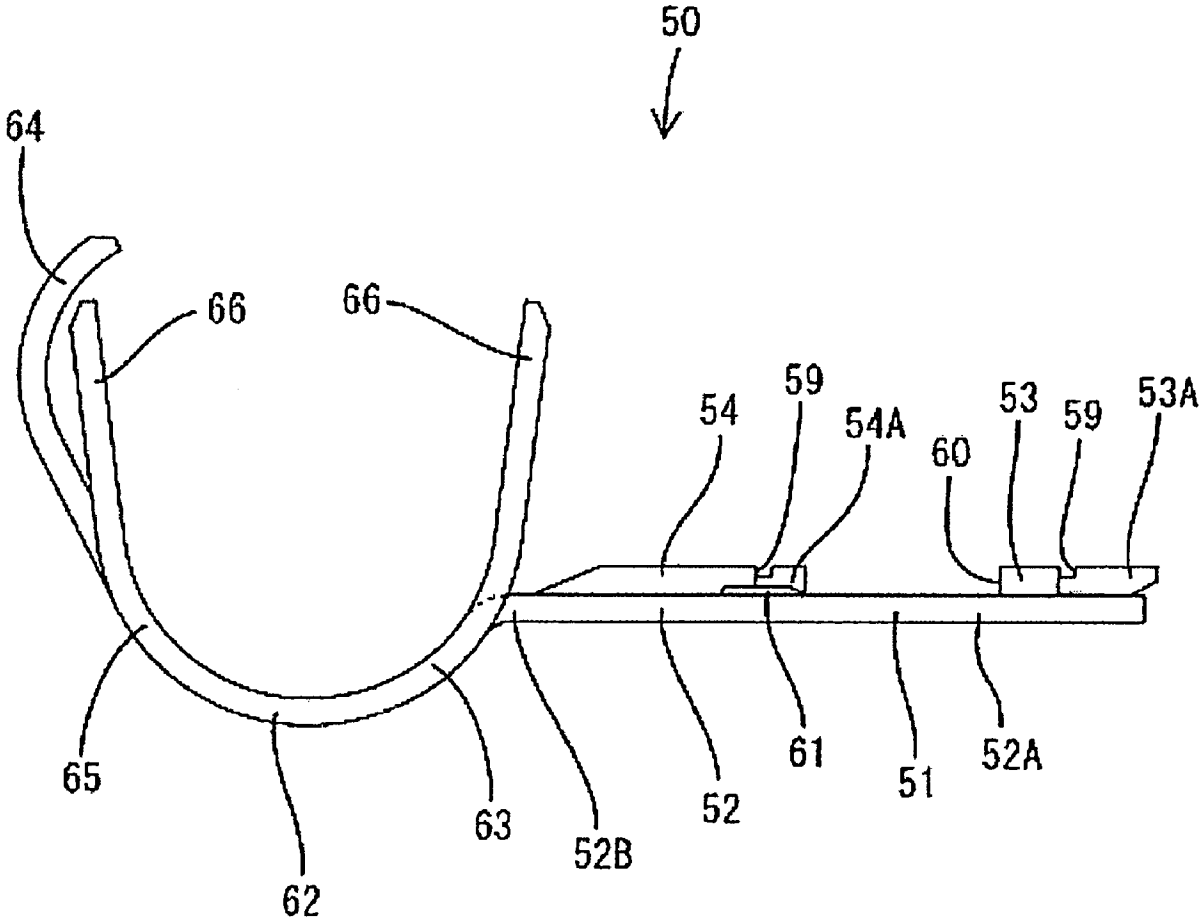
FIG. 8 is a front view of the lower ground terminal.
Figure 9:
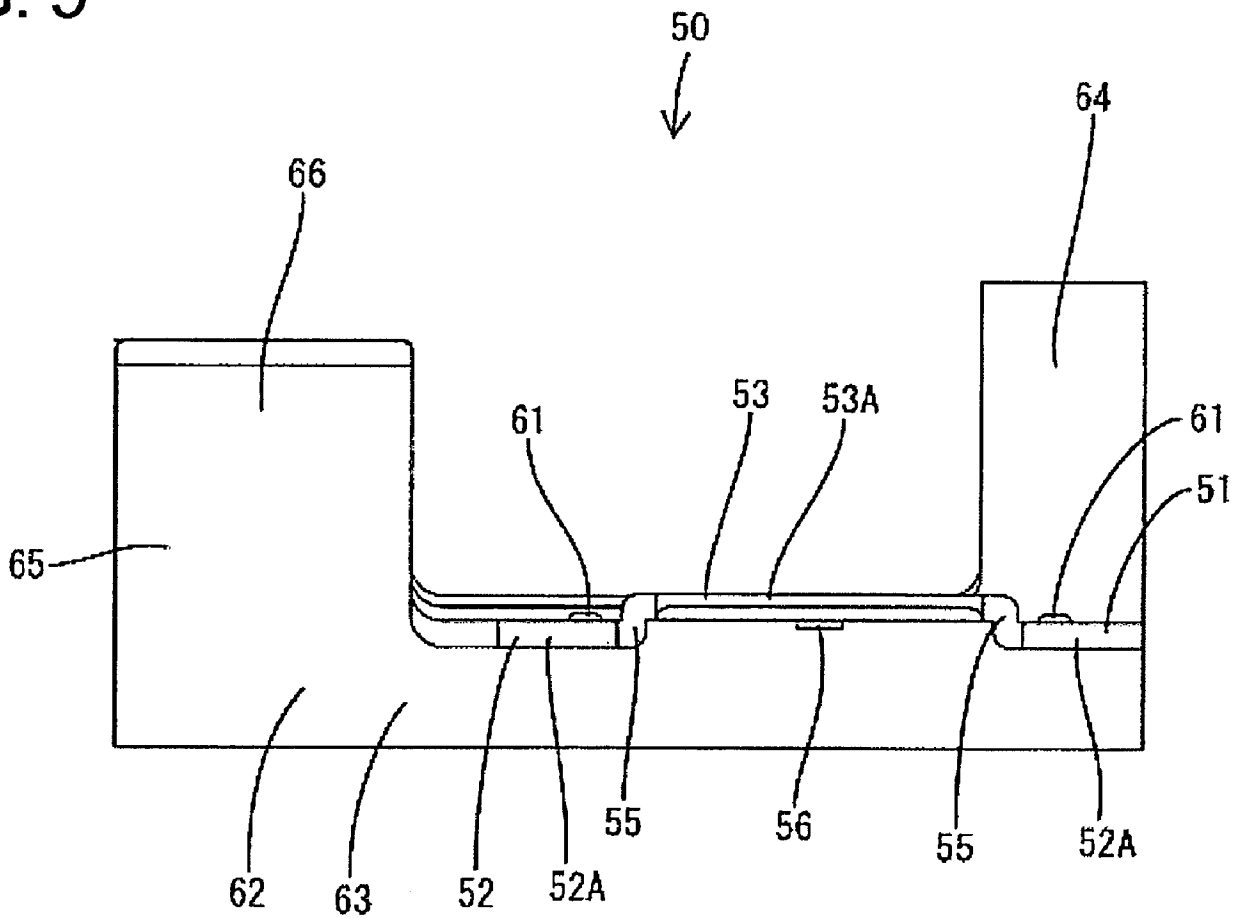
FIG. 9 is a left side view of the lower ground terminal.

The first engaging portion 53 is stepped up from the flat plate 52 at the front and rear connections with the extensions 52A so that substantially all of the first engaging portion 53 is higher than the flat plate 52 by about the thickness of the plate as shown in FIG. 8. A first inserting portion 53A is defined at a lateral part of the first engaging portion 53, right part in FIG. 8, and extends to the right in FIG. 8 along the plate surface. Open ended slits 55 are formed between the front and rear end edges of the first inserting portion 53A and the front and rear extensions 52A. A middle part of the first inserting portion 53A is embossed to form a lock 56 that slopes down and to the left in FIG. 2.

The second engaging portion 54 is stepped up at the front and rear ends and connects with the extensions 52A. Therefore, the second engaging portion 53 is higher than the flat plate 52 by about the thickness of the plate, as shown in FIG. 8. As a result, the first and second engaging portions 53, 54 are substantially flush with each other. A second inserting portion 54A is defined at a lateral part of the second engaging portion 54 (right part in FIG. 8) and extends laterally (to the right in FIG. 8) substantially along the plate surface. Open ended slits 57 are formed between the front and rear end edges of the second inserting portion 54A and the front and rear extensions 52A. Further, a locking hole 58 penetrates the second engaging portion 54 in the thickness direction and has a substantially rectangular shape slightly longer in forward and backward directions FBD.

Grooves 59 are recessed in the upper surfaces of the first and second inserting portions 53A, 54A near the base ends of the first and second inserting portions 53A, 54A and extend in substantially forward and backward directions FBD over substantially the entire length range. The first and second inserting portions 53A, 54A are slightly resiliently displaceable up and down at the grooves 59 (see FIGS. 3 and 8).

An insertion hole 60 is defined by the two extensions 52A and the first and second engaging portions 53 and 54 for receiving the unillustrated bolt. This insertion hole 60 has substantially the same rectangular shape as the insertion hole 40 of the upper joint 31, and hence is longer in forward and backward directions FBD (length direction LD of the shielded cables 20).

The first and second engaging portions 33, 34 of the upper joint 31 and the first and second engaging portions 53, 54 of the lower joint 51 have rotational symmetries through 180° with respect to an axis extending in forward and backward directions FBD, and structures around the insertion holes 40, 60 of the upper and lower joints 31, 51 are substantially symmetrical with respect to this axis. The upper and lower joints 31, 51 are assembled with the insertion holes 40, 60 substantially aligned and are slid in the extending directions thereof to be placed one over the other (see FIGS. 1 and 2).

Contacts 41, 61 are embossed or cut and bent at positions on the extensions 32A, 52A of the upper and lower joints 31, 51 at the front and rear sides of the second engaging portions 34, 54 (see FIG. 3). The contacts 41 of the upper joint 31 project down and the contacts 61 of the lower joint project up. The contacts 41, 61 have oblong cross sections longer in the transverse direction when viewed from above (see FIGS. 3, 4 and 8). Each contact 41, 61 is formed with a slant extending from the projecting end thereof and has a downward inclination toward the front with respect to an assembling direction, so that the upper and lower joints 31, 51 can be assembled smoothly. The contacts 41, 61 contact the mating joints 51, 31 at four positions substantially corresponding to the corners of the insertion holes 40, 60 when the upper and lower joints 31, 51 are assembled. Thus, the upper and lower joints 31, 51 will not warp significantly and a reliable electrical connection can be established between the upper and lower ground terminals 30, 50.

The cable mounts 42, 62 are provided at the sides of the upper and lower joints 31, 51 substantially opposite to those facing each other, as shown in FIG. 3. The respective cable mounts 42, 62 extend forward (up in FIG. 3) from lateral edges of the upper and lower joints 31, 51. Each cable mount 42, 62 has an arcuate cross section that substantially conforms with a part of the lower side of the outer coating 24 of the shielded cable 20 and extends in the lengthwise direction LD of the shielded cable 20, as shown in FIG. 2.

Arcuate standing portions 43, 63 of the cable mounts 42, 62 are substantially continuous with the corresponding upper and lower joints 31, 51. The arcuate standing portions 43, 63 are placed in contact with the outer circumferential surfaces of the shielded cables 20 over about half the circumference or an area slightly smaller than half the circumference. The arcuate standing portions 43, 63 contact the lower halves of the respective shielded cables 20 in section in the transverse directions of the upper and lower joints 31, 51, and form part of displacement preventing means for preventing displacements of the shielded cables 20 when the upper and lower joints 31, 51 are assembled.

Barrel pieces 44, 64 project at upper edges of the respective arcuate standing portions 43, 63 substantially opposite to the upper and lower joints 31, 51 and within the length range of the upper and lower joints 31, 51 (see FIGS. 1 and 2). The barrel pieces 44, 64 are crimped, bent or folded into connection with the outer coatings 24 of the shielded cables 20 and form part of the displacement preventing means together with the arcuate standing portions 43, 63. The shielded cables 20 are secured by the barrel pieces 44, 64 over more than about half, and preferably over about ¾ of their circumferences.

Shields 45, 65 are provided near the front ends of the cable mounting portions 42, 62 at positions displaced forward from the upper and lower joints 31, 51 in the lengthwise direction LD of the shielded cables 20 (see FIGS. 1 and 3). The shields 45, 65 have crimping pieces 46, 66 that project from the left and right upper edges of the arcuate standing portions 43, 63. The crimping pieces 46 and 66 can be crimped, bent or folded into connection with the outer coating 24, as shown in FIGS. 4 and 8. The braided wires 23 are folded back towards the outer circumferential surfaces of the outer coatings 24 and are placed on the outer circumferential surfaces of the crimping pieces 46, 66 that have been crimped into connection with the outer coatings 24 of the shielded cables 20. Crimp rings 47, 67 then are crimped, bent, folded or deformed into connection with the outer circumferential surfaces of the folded back braided wires 23 (see also FIG. 11). Thus, the braided wires 23 are squeezed between the shields 45, 65 and the crimp rings 47, 67 to be secured firmly to the shields 45, 65. In this way, the crimp rings 47, 67 are crimped, bent, folded or deformed with the crimping pieces 46, 66 placed under the braided wires 23. Thus, crimping forces act more reliably act on the braided wires 23 as compared to a case where crimp rings are crimped with the braided wires 23 placed directly on the outer coatings 24 of the shielded cables 20.

Leading end portions of the inner and outer coatings 22 and 24 of the shielded cables 20 are stripped off to expose the leading end portions of the cores 21 and braided wires 23 before mounting the device connection terminals 10 and the upper and lower ground terminals 30, 50 on the respective shielded cables 20. One crimp ring 47, 67 then is mounted at a position on each shielded cable 20 relatively close to the leading end of the shielded cable 20.

Figure 10:
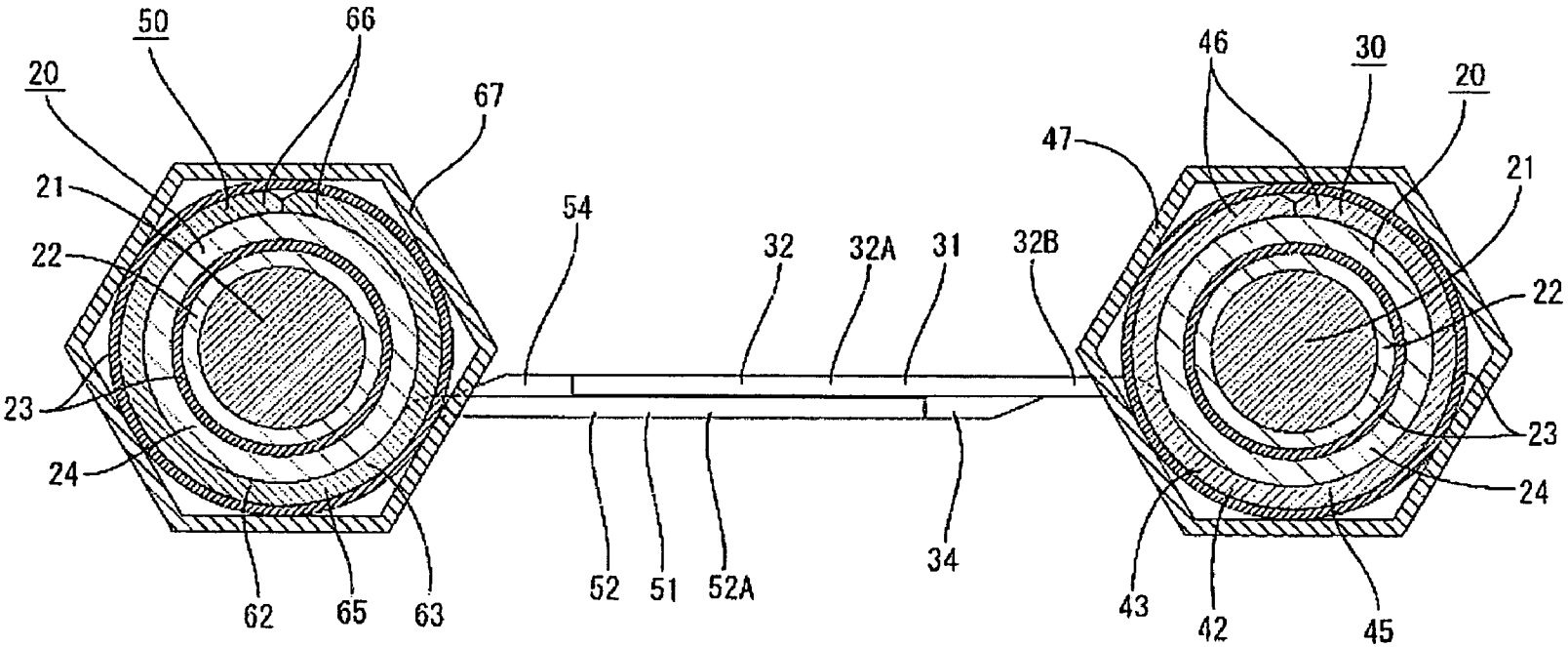
FIG. 10 is a side view before crimp rings are crimped.
Figure 11:
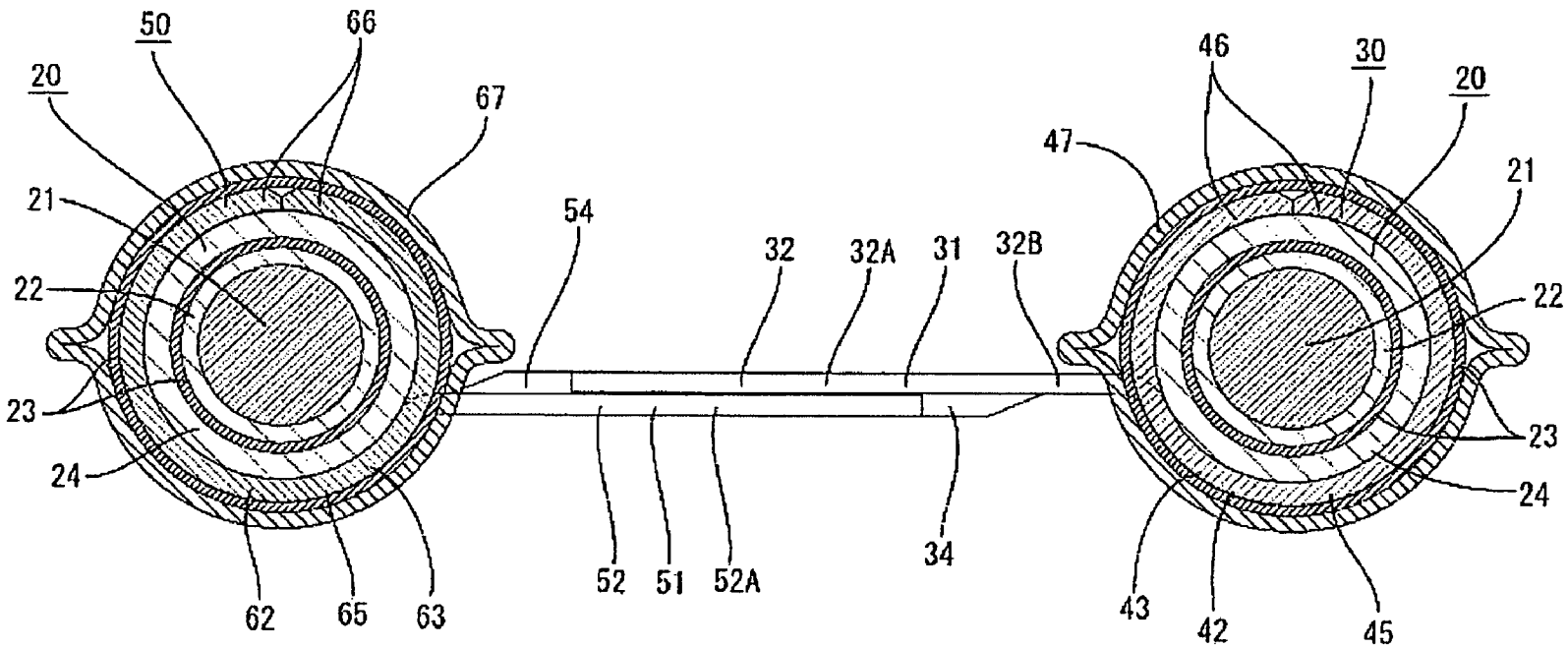
FIG. 11 is a section showing after the crimp rings are crimped.

The respective device connection terminals 10 are connected with the exposed cores 21 by crimping, bending or folding the crimping portions 12. The shields 45, 65 then are positioned at the leading end portions of the corresponding outer coatings 24. The crimping pieces 46, 66 of the shields 45, 65 and the barrel pieces 44, 64 of the cable mounting portions 42, 62 then are crimped, bent or folded into connection with the leading end portions of the outer coatings 24. The exposed braided wires 23 then are folded back onto the outer circumferential surfaces of the crimping pieces 46, 66 of the shields 45, 65. The crimp rings 47, 67 are moved into positions aligned with the folded back braided wires 23 and the crimping pieces 46, 66, as shown in FIG. 10. The respective crimp rings 47, 67 then are crimped, bent, folded or deformed at opposite sides to form flanges or flattened portions, as shown in FIG. 11, to reduce the diameters of the crimp rings 47, 67, and to squeeze the braided wires 23 together with the respective crimping pieces 46, 66.

Two shielded cables 20 are arranged substantially side by side after the device connection terminals 10 and the upper and lower ground terminals 30, 50 are mounted on the respective shielded cables 20. Thus, the upper and lower joints 31, 51 substantially face each other. The leading ends of the shielded cables 20 are held where the upper and lower ground terminals 30, 50 are mounted and the shielded cables 20 then are brought closer together. Thus, the first engaging portions 33, 53 of the upper and lower joints 31, 51 are inserted into the mating insertion holes 40, 60 and the upper joint 31 is placed on the upper surface of the lower joint 51. The upper and lower joints 31, 51 then are slid in approaching directions along the plate surfaces of the upper and lower joints 31, 51. Thus, the first and second inserting portions 33A and 34A of the upper ground terminal 30 move to positions below the first and second inserting portions 53A, 54A of the lower ground terminal 50. Additionally, the locking projections 36, 56 of the respective first inserting portions 33A, 53A contact each other to deform the first inserting portions 33A, 53A slightly along the thickness direction. The upper and lower ground terminals 30, 50 then are slid further. As a result, the first and second engaging portions 33 and 34 of the upper ground terminal 30 and the first and second engaging portions 53, 54 of the lower ground terminal 50 are inserted to a position where the first engaging portion 33 and the second engaging portion 54 and the second engaging portion 34 and the first engaging portion 53 overlap each other. Additionally, the connected parts of the first and second engaging portions 33, 34 with the extensions 32A are inserted into the mating slits 57, 55 and the connected parts of the first and second engaging portions 53, 54 with the extensions 52A are inserted into the mating slits 37, 35. The first inserting portions 33A, 53A resiliently restore when the upper and lower ground terminals 30, 50 reach a proper assembled position with the insertion holes 40, 60 aligned and the locking projections 36, 56 engaged with the mating locking holes 58, 38 to prevent sliding movements of the upper and lower joints 36, 56 in separating directions. In this way, the first engaging portions 33, 53 are inserted at the opposite surfaces of the mating second engaging portions 54, 34 and the upper and lower ground terminals 30, 50 are held assembled by the engagement of the first engaging portions 33, 53 and the second engaging portions 54, 34.

To slide the upper and lower joints 31, 51 substantially into contact in this assembling operation, forces are exerted on the shielded cables 20 in transverse directions (directions toward or away from each other). At this time, the shielded cables 20 are brought into contact with the arcuate standing portions 43, 63 formed at the cable mounting portions 42, 62 and/or localized by the barrel pieces 44, 64 projecting from the arcuate standing portions 43, 63.

Therefore displacements of the shielded cables 20 relative to the upper and lower ground terminals 30, 50 can be substantially prevented. The prior art has no displacement preventing means comparable to the arcuate standing portions 43, 63 and/or the barrel pieces 44, 64. The shielded cables 20 are displaced relative to the prior art ground terminals if forces are exerted to the shielded cables 20. Thus, forces cannot act properly and the prior art assembling operation difficult. However, forces exerted to the shielded cables 20 are transmitted effectively to the upper and lower ground terminals 30, 50 in this embodiment. Therefore, displacements between the upper and lower ground terminals 30 50 and the respective shielded cables 20 are prevented, and the assembling operation can be performed smoothly.

The arcuate standing portions 43, 63 that form part of the displacement preventing means utilize the cable mounting portions 42, 62. Thus, the structures of the ground terminals 30, 50 are simplified as compared to the case where displacement preventing members are mounted separately.

The barrel pieces 44, 64 also form part of the displacement preventing means and are arranged at the sides of the cable mounting portions 42, 62 opposite to the upper and lower joints 31, 51 within the length range of the upper and lower joints 31, 51. Thus, lengthwise enlargement of the upper and lower ground terminals 30, 50 in the lengthwise direction can be avoided.

The device connection terminals 10 mounted at the leading ends of the shielded cables 20 are connected with a device after the upper and lower ground terminals 30, 50 are assembled. More particularly, the bolt is passed through the insertion holes 40, 60 of the upper and lower ground terminals 30, 50 and tightened so that the upper and lower ground terminals 30, 50 can be attached to a grounding member (not shown), such as an automotive body or the like. It should be noted that the device connection terminals 10 easily can be connected with the device since the spacing between the shielded cables 20 is held substantially constant by the upper and lower ground terminals 30, 50.

The shields 45, 65 are formed at positions displaced forward from the upper and lower joints 31, 51, and the braided wires 23 are placed over the parts of the ground terminals 30, 50 before the grounding positions of the upper and lower joints 31, 51. Thus, assuming a specified distance between the installation position of the device and the grounding positions, unshielded areas can be shortened as compared to a conventional case where the shields to be connected with the braided wires and the joints to be grounded are formed at the same positions with respect to forward and backward directions.

The insertion holes 40, 60 are longer in the lengthwise direction LD of the shielded cables 20. Thus, the mounting operation can be performed without a problem even if there is a variation in the distance between the installation position of the device and the grounding positions.

As described above, the upper and lower ground terminals 30, 50 first are mounted on the respective shielded cables 20 with the shielding portions 45, 65 connected with the braided wires 23. The upper and lower joints 31, 51 bulge out and face each other when shielded cables 20 are arranged side by side. The shielded cables 20 then are brought towards each other and the upper and lower joints 31, 51 are slid while being placed one over the other, and the upper and lower joints 31, 51 are assembled with the insertion holes 40, 60 aligned. The shielded cables 20 are held in contact with the arcuate standing portions 43, 63 and the barrel pieces 44, 64 to have displacements prevented upon this assembling operation. Thus, operation forces can be transmitted reliably to the upper and lower joints 31, 51 via the shielded cables 20, with the result that the assembling operation can be smoothly performed.

The invention is not limited to the above described and illustrated embodiment. For example, the following embodiments are also embraced by the technical scope of the present invention. Beside the following embodiments, various changes can be made without departing from the spirit of the invention.

The shielding layer is the braided wire 23 in the foregoing embodiment. However, the invention is also applicable to cases where the shielding layer is formed by using an electrically conductive metal foil or an electrically conductive metal wire or by applying metal coating by means of vapor deposition, plating or plasma spraying.

The braided wires 23 are folded back onto the shielding portions 45, 65 and are crimped into connection with the outer coatings 24 in the foregoing embodiment. However, the outer coating may simply be stripped off to expose the braided wires 23 and the shields of the ground terminals may be crimped into connection with the exposed parts of the braided wires 23.

The barrel pieces 44, 64 are arranged within the length range of the upper and lower joints 31, 51 in the foregoing embodiment. However, the invention is not limited thereto and the barrel pieces may be provided at positions outside this length range. In such a case, the barrel pieces may be formed on the lateral edges of the cable mounting portions toward the joint portions or on the opposite lateral edges of the cable mounting portions.

In the foregoing embodiment, the shields 45, 65 are crimped into connection with the outer coatings 24 of the shielded cables 20 to mount the upper and lower ground terminals 30, 50, the braided wires 23 then are folded back onto the shields 45, 65, and, then the crimp rings 47, 67 are crimped into connection with the outer circumferential surfaces of the folded back braided wires 23. However, the invention is not limited thereto. The braided wires may be folded back onto the crimp rings after the crimp rings are crimped into connection with the outer coatings of the shielded cables and, then, the shields may be crimped into connection with the outer circumferential surfaces of the folded back braided wires to mount the ground terminals.

What is claimed is:

1. A ground terminal assembly for first and second shielded cables having first and second device connection terminals connected respectively at leading ends thereof, the ground terminal assembly having first and second ground terminals, each of the first and second ground terminals comprising:

a cable mounting portion to be mounted on outer coatings of the respective shielded cables, a shield at one end of the corresponding cable mounting portion and connectable with a shielding layer of the corresponding shielded cable, a joint bulging out from the corresponding cable mounting portion at an angle to a lengthwise direction of the shielded cable, and a displacement preventing means on the cable mounting portion for contacting the shielded cable and preventing displacements of the shielded cable, the displacement preventing means extending along the respective cable mounting portion in the lengthwise direction from the respective shielded cable and being configured for extending partly around the respective cable to a side of the cable mounting portion substantially opposite the respective joint, the joints substantially facing each other and being configured for assembly with each other by being slid along extending directions thereof.

2. The ground terminal assembly of claim 1, wherein the joints are at positions displaced back from the shields (45, 65) in the lengthwise direction of the shielded cables.

3. The ground terminal assembly of claim 1, wherein at least one arcuate standing portion is formed on the inner surface of each cable mounting portion and has an arcuate shape conformable to the outer circumferential shape of the outer coating of the shielded cable, the joints being substantially continuous with upper edges of the arcuate standing portions and the arcuate standing portions defining part of the displacement preventing means.

4. The ground terminal assembly of claim 1, wherein the joints have insertion holes disposed for alignment with one another when the joints are placed one over the other and slid along extending directions thereof.

5. The ground terminal assembly of claim 4, wherein the insertion holes are long in the lengthwise direction of the shielded cables.

6. The ground terminal assembly of claim 1, wherein at least one barrel piece stands near a lateral edge of at least one cable mounting portion and is configured for crimped connection with the outer coating of the corresponding shielded cable, the barrel piece forming part of the displacement preventing means.

7. The ground terminal assembly of claim 6, wherein the barrel piece is arranged at the lateral edge of the corresponding cable mounting portion substantially opposite to the joint at least partly within the length range of the joint.

8. The ground terminal assembly of claim 1, wherein each shield has at least two crimping pieces for connection with the outer coating.

9. The ground terminal assembly of claim 8, wherein each shielding layer exposed by partly stripping off the outer coating near an end portion of the shielded cable is folded back towards the outer circumferential surface of the outer coating so as to be placed on both crimping pieces, and at least one crimp ring is crimped into connection with the outer circumferential surface of each folded back shielding layer.

10. A ground terminal assembly for first and second shielded cables having first and second connection terminals connected respectively at leading ends thereof, the ground terminal assembly comprising:

a first ground terminal having an elongate first cable mounting portion to be extended along and mounted on a portion of an outer coating of the first shielded cable, a first shield at one end of the first cable mounting portion and being configured for connection with a shielding layer of the first shielded cable, a first joint extending from a side of the first cable mounting portion substantially normal to a lengthwise direction of the first shielded cable, a first standing portion extending along the first cable mounting portion from the first shield towards an end of the first cable mounting portion opposite the first shield, the standing portion being configured to extend partly around the first cable towards a side of the first cable substantially opposite the first joint;

a second ground terminal having an elongate second cable mounting portion to be extended along and mounted on a portion of an outer coating of the second shielded cable, a second shield at one end of the second cable mounting portion and being configured for connection with a shielding layer of the second shielded cable, a second joint extending from a side of the second cable mounting portion substantially normal to a lengthwise direction of the second shielded cable, a second standing portion extending along the second cable mounting portion from the second shield towards an end of the second cable mounting portion opposite the second shield, the standing portion being configured to extend partly around the second cable towards a side of the second cable substantially opposite the second joint, the first and second joints substantially facing each other and being configured for locked assembly with each other by being slid along extending directions thereof.

11. The ground terminal assembly of claim 10, wherein the first ground terminal further comprises a first barrel piece at an end of the first cable mounting portion opposite the first shield, the first barrel piece being configured for crimped connection with the outer coating of the first shielded cable, and wherein the second ground terminal has a second barrel piece at an end of the second cable mounting portion opposite the second shield, the second barrel piece being configured for crimped connection with the outer coating of the second shielded cable.

12. The ground terminal assembly of claim 11 wherein the first and second barrel pieces are at positions along the respective first and second cable mounting portions to at least partly aligned with a respective first and second joints.

* * * * *